US008516937B2

(12) United States Patent
Koide et al.

(10) Patent No.: US 8,516,937 B2
(45) Date of Patent: Aug. 27, 2013

(54) BLAST TREATMENT METHOD AND BLAST TREATMENT DEVICE

(75) Inventors: Kenji Koide, Kobe (JP); Ryusuke Kitamura, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 63 days.

(21) Appl. No.: 13/262,028

(22) PCT Filed: Mar. 24, 2010

(86) PCT No.: PCT/JP2010/002063

§ 371 (c)(1),
(2), (4) Date: Sep. 29, 2011

(87) PCT Pub. No.: WO2010/113426

PCT Pub. Date: Oct. 7, 2010

(65) Prior Publication Data

US 2012/0017750 A1 Jan. 26, 2012

(30) Foreign Application Priority Data

Mar. 31, 2009 (JP) ..... 2009-084662

(51) Int. Cl.
*F42D 5/04* (2006.01)

(52) U.S. Cl.
USPC ..... 86/50

(58) Field of Classification Search
USPC ..... 86/50; 588/403, 401, 313, 249.5; 89/1.13
See application file for complete search history.

(56) References Cited

U.S. PATENT DOCUMENTS 3,109,369 A * 11/1963 Plumley ..... 86/50
3,117,518 A * 1/1964 Porter et al. ..... 102/307
6,245,958 B1 * 6/2001 Morse et al. ..... 588/318

(Continued)

FOREIGN PATENT DOCUMENTS

JP 2003 314998 11/2003
JP 2005 241154 9/2005

(Continued)

OTHER PUBLICATIONS

International Search Report Issued Issued Jul. 20, 2010 in PCT/JP10/002063 filed Mar. 24, 2010.

(Continued)

*Primary Examiner* — Bret Hayes
*Assistant Examiner* — Reginald Tillman, Jr.
(74) *Attorney, Agent, or Firm* — Oblon, Spivak, McClelland, Maier & Neustadt, L.L.P.

(57) ABSTRACT

Provided is a blast treatment method that enables blast treatment of a treatment subject in a sealed container to be carried out easily and safely. This blast treatment method implements: a shaped charge placement step of placing a shaped charge 70 at a location outside a sealed container 40; a blasting explosive placement step of placing a blasting explosive 20 for blasting a treatment subject 10 at a location outside the sealed container 40; a housing step of housing the sealed container 40 in which the treatment subject 10 is housed in a sealable chamber 90; a dividing step of initiating the shaped charge 70 and dividing the sealed container 40 at prescribed dividing surfaces 40*a* and 40*b* with the initiated shaped charge 70 to expose the treatment subject 10; and a blasting step of blast-treating the exposed treatment subject 10 with the blast energy of the blasting explosive 20 by initiating the blasting explosive 20 in the sealed chamber 90.

16 Claims, 11 Drawing Sheets

(56) References Cited

U.S. PATENT DOCUMENTS

| | | | | |
|---|---|---|---|---|
| 6,453,788 | B1 * | 9/2002 | Lebet et al. | 86/50 |
| 6,470,783 | B2 * | 10/2002 | Ito et al. | 86/50 |
| 7,631,588 | B2 * | 12/2009 | Osterloh | 86/50 |
| 8,006,600 | B2 | 8/2011 | Fujiwara et al. | |
| 2009/0131733 | A1 | 5/2009 | Asahina et al. | |

FOREIGN PATENT DOCUMENTS

| | | |
|---|---|---|
| JP | 2007 271136 | 10/2007 |
| JP | 2007 309550 | 11/2007 |
| JP | 2008 14595 | 1/2008 |
| JP | 2008 309954 | 12/2008 |

OTHER PUBLICATIONS

U.S. Appl. No. 13/262,070, filed Sep. 29, 2011, Koide, et al.
U.S. Appl. No. 13/262,055, filed Sep. 29, 2011, Koide, et al.
U.S. Appl. No. 13/262,419, filed Sep. 30, 2011, Koide, et al.
U.S. Appl. No. 13/262,433, filed Sep. 30, 2011, Fujiwara, et al.
U.S. Appl. No. 13/262,245, filed Sep. 30, 2011, Koide, et al.
U.S. Appl. No. 13/262,448, filed Sep. 30, 2011, Asahina, et al.
Translation of the International Preliminary Report on Patentability with Written Opinion issued Nov. 24, 2011, in PCT Application No. PCT/JP2010/002063.

* cited by examiner

BLAST TREATMENT METHOD AND BLAST TREATMENT DEVICE

TECHNICAL FIELD

The present invention relates to a blast treatment method for blast treatment of military and other ammunitions.

Background Art

The configuration of military ammunitions (such as artillery shells, bombs, landmines or underwater mines) is known to consist of the providing of a bursting charge and a chemical agent within a steel shell.

Blast treatment is known to be employed for the treatment of these explosives. Since blast treatment does not require disassembly work, it can be applied to not only the treatment of ammunitions that remain well-preserved, but also ammunitions that are difficult to disassemble due to deterioration over time and deformation. In the case of treating ammunitions having chemical agents that are harmful to the human body, the application of this treatment method offers the advantage of being able to completely decompose nearly whole the chemical agents by realizing an ultra-high temperature field and ultra-high pressure field based on an explosion. An example of this type of blast treatment method is disclosed in Patent Document 1.

In the method disclosed in Patent Document 1, a treatment subject is placed in a container, and together with arranging an ANFO explosive around the treatment subject, a sheet-like explosive having a higher detonation velocity than the ANFO explosive is wrapped around the container followed by initiation of a prescribed end of the sheet-like explosive. As a result of this initiation, the sheet-like explosive sequentially detonates in a prescribed direction, and as a result of the ANFO explosive sequentially detonates in a prescribed direction accompanying detonation of the sheet-like explosive, the treatment subject is blast-treated while the shell of the treatment subject is destroyed and the explosive charge provided in the treatment subject explodes.

The conventional blast treatment method described above is a method for treating ammunitions only. Namely, this conventional blast treatment method is a method that consists of destroying a shell, which is destroyable by a burster provided inside the shell, by detonating ANFO explosive. Thus, in the case of applying this conventional method to, for example, an ammunition in which the explosive is housed in a sealed container that is sturdier than a shell and the like in order to prevent escape of a chemical agent contained in the ammunition, there is the risk of being unable to adequately destroy the ammunition housed inside the sealed container.

Patent Document 1: Japanese Patent Application Laid-open No. 2008-309954

SUMMARY OF THE INVENTION

Therefore, an object of the present invention is to provide a blast treatment method capable of treating ammunitions housed in a sealed container easily and more safely.

In order to achieve this object, the blast treatment method of the present invention is a method for blast-treating with an explosive a treatment subject housed in a sealed container, the method including: a shaped charge placement step of placing a shaped charge, in which metal plates are integrally molded with an explosive for generating an ultra-high-pressure metal jet in a prescribed direction by colliding the metal plates, at a location outside the sealed container; a blasting explosive placement step of placing a blasting explosive for blasting the treatment subject at a location outside the sealed container; a housing step of housing in a sealable chamber a sealed container in which the treatment subject is housed and housing in a state in which the shaped charge and the blasting explosive are placed at a location outside the sealed container; a dividing step of initiating the shaped charge in the chamber and dividing the sealed container along a prescribed cutting surface with the initiated shaped charge to expose the treatment subject within the chamber; and a blasting step of blast-treating the treatment subject exposed in the chamber with blast energy of the blasting explosive by initiating the blasting explosive in the chamber.

According to this method, the treatment subject being exposed comparatively easily as a result of the sealed container being divided by the shaped charge in the chamber, the exposed treatment subject is treated while still housed in the chamber by the blast energy of the blasting explosive placed outside the sealed container. This prevents a harmful chemical agent contained in the treatment subject from being dispersed to the outside, and enables the chemical agent to be blast-treated safely and easily.

EMBODIMENTS FOR CARRYING OUT THE INVENTION

Figure 1:
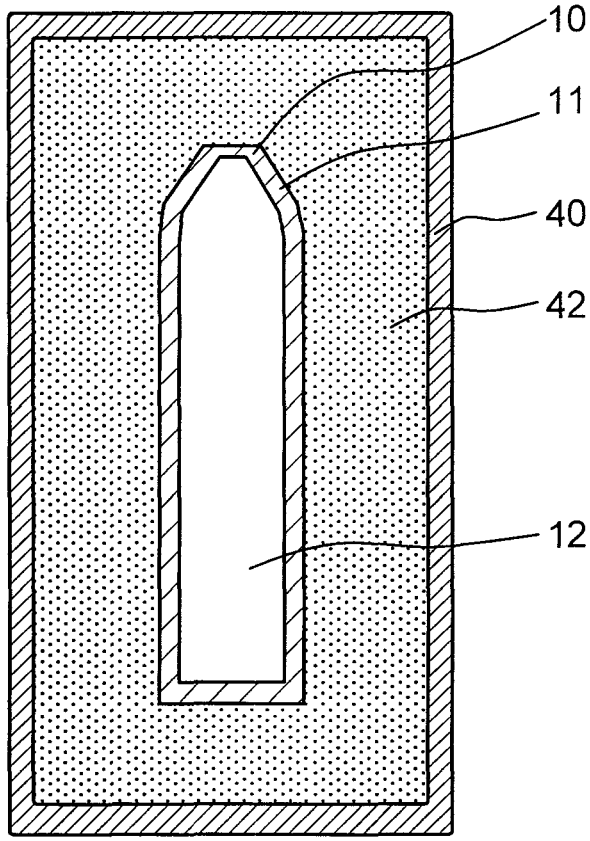
FIG. 1 is a cross-sectional view showing a state in which a subject to be blast-treated by the blast treatment method according to the present invention is housed in a sealed container.
Figure 2:
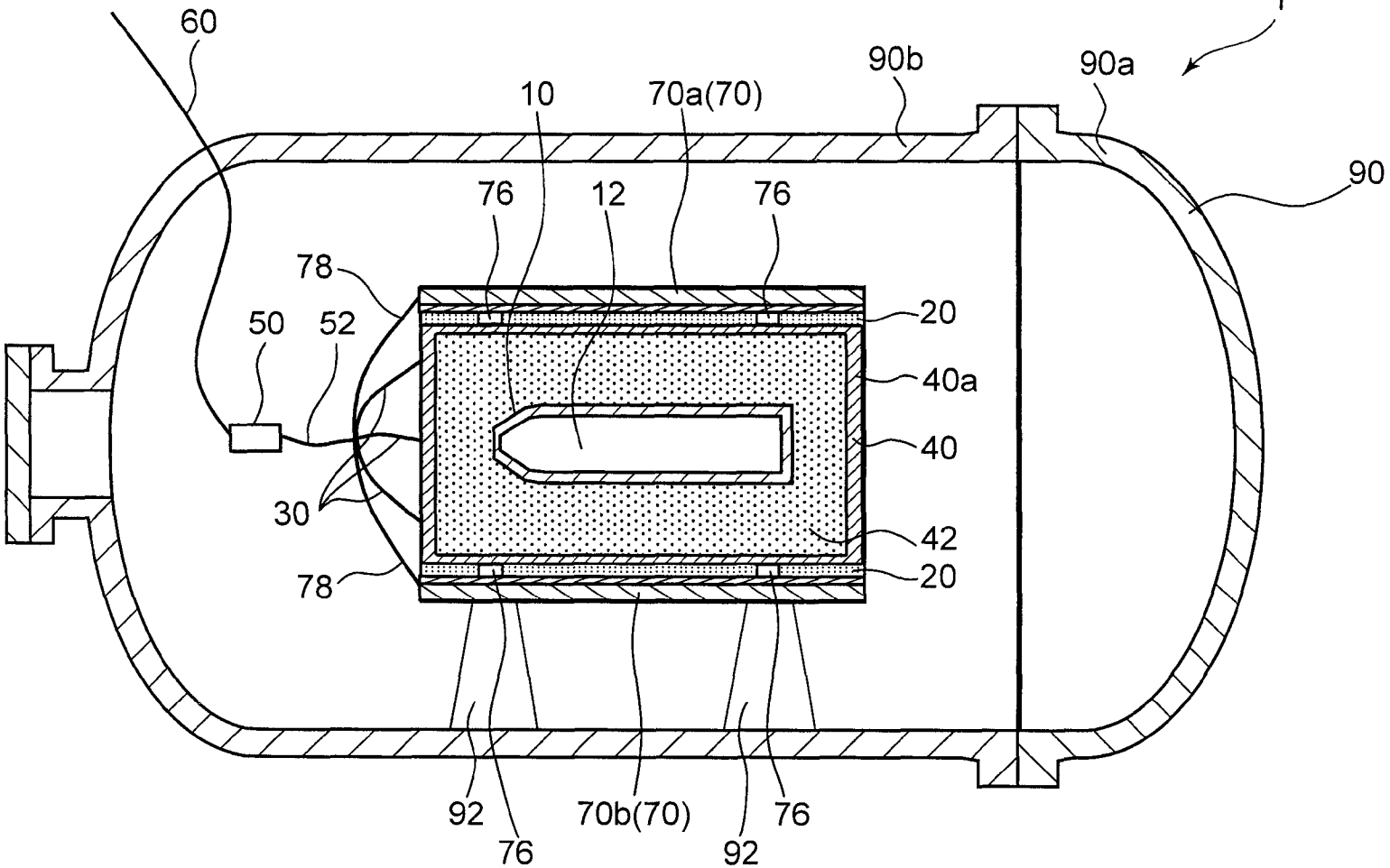
FIG. 2 is a longitudinal cross-sectional view of a blast treatment device according to a first embodiment of the present invention.
Figure 3:
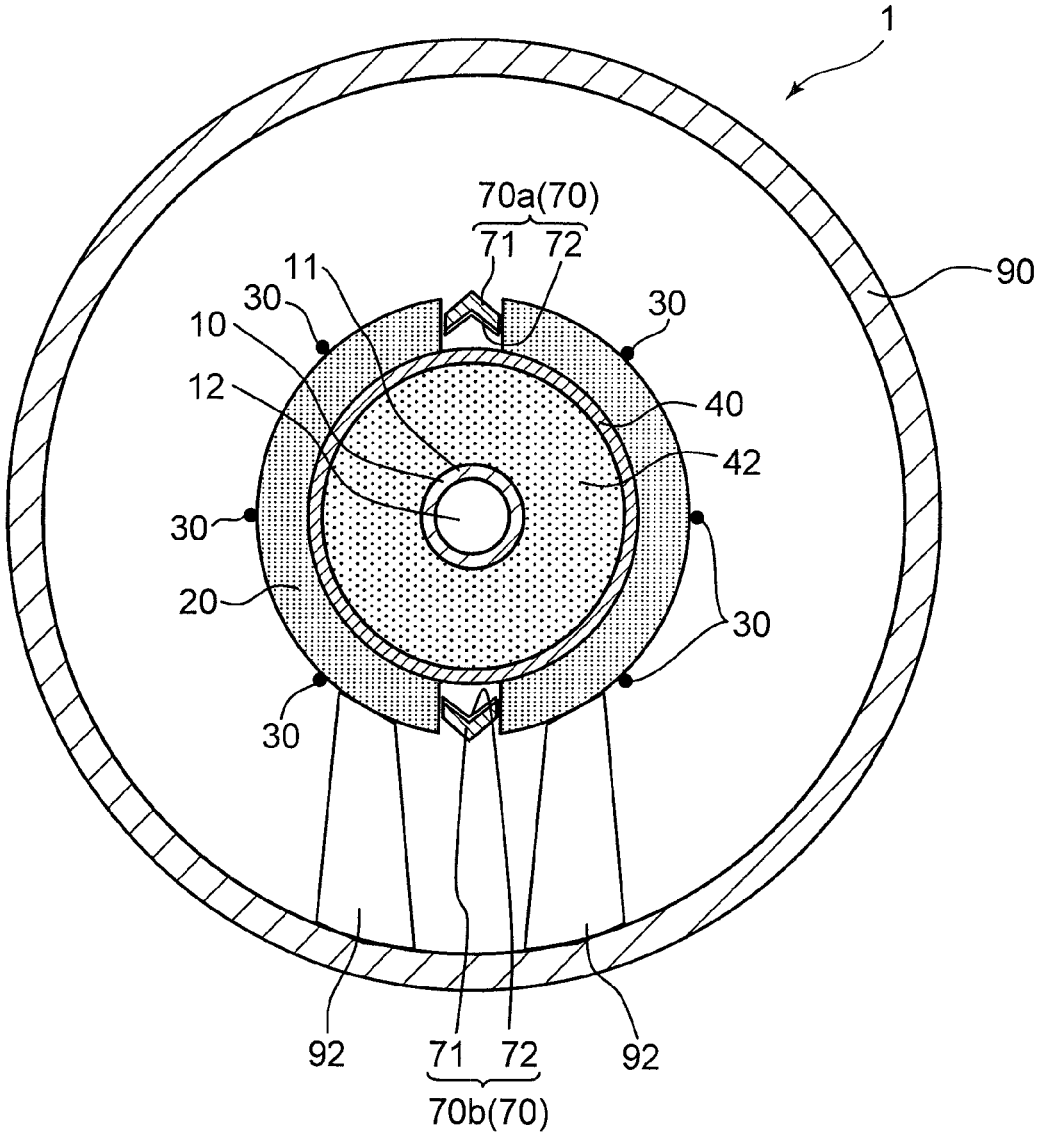
FIG. 3 is a latitudinal cross-sectional view of a blast treatment device according to a first embodiment of the present invention.
Figure 4:
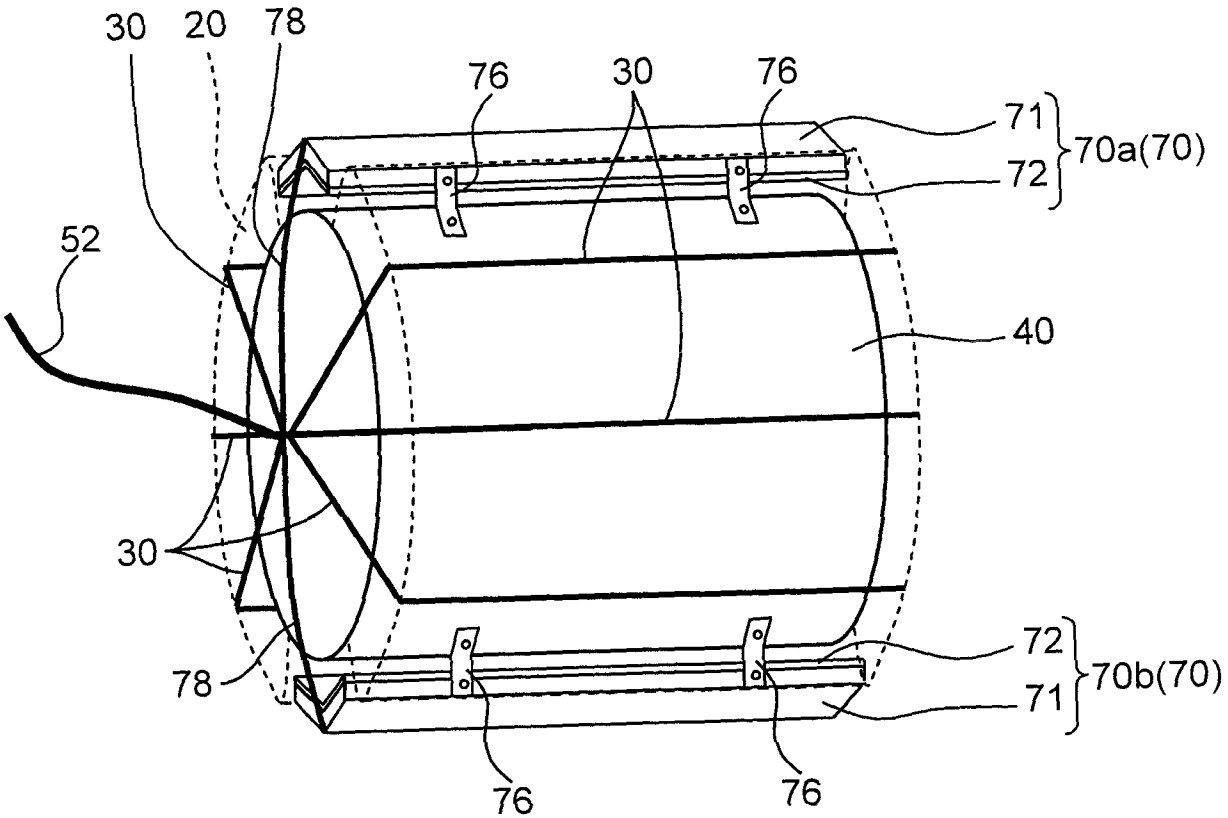
FIG. 4 is a perspective view showing the inside of a blast treatment device according to a first embodiment of the present invention.

The following provides an explanation of a first embodiment of the blast treatment method according to the present invention with reference to the drawings. FIG. 1 is a cross-sectional view of a state in which a chemical ammunition 10 is housed in a sealed container 40, the chemical ammunition 10 indicated as an example of a subject to be blast-treated by the present blast treatment method. In addition, FIGS. 2 and 3 are each schematic cross-sectional views of a blast treatment device 1 used in the present blast treatment method, while FIG. 4 is a schematic perspective view showing an enlarged view of the inside of the blast treatment device 1.

The chemical ammunition 10, which is an example of a treatment subject, has an elongated shape in the axial direction as shown in FIG. 1, and is composed of a steel shell (casing) 11 and a harmful substance in the form of a chemical agent 12 housed within this shell. This chemical ammunition 10 is housed in the sealed container 40 while covered with a cushioning material 42 to prevent escape of the chemical agent 12 to the outside. The sealed container 40 has a roughly cylindrical shape extending in the axial direction of the chemical ammunition 10.

The present blast treatment method is a method for rendering the above-mentioned chemical ammunition 10 harmless by blast treatment while housed in the sealed container 40. In this blast treatment method, the blast treatment device 1 is used as shown in FIG. 2, for example. This blast treatment device 1 has a shaped charge 70, an inner explosive (blasting explosive) 20, cord-like explosive elements 30, an electric detonator (initiation device) 50 and a chamber 90.

The shaped charge 70 is for dividing the sealed container 40. Here, a dividing charge 70 is used that has metal liners (metal plates) 72 having a roughly V-shaped cross-section, and explosive charges 71 provided along the lateral surface on the side to which the metal liners 72 protrude as shown in FIG. 3. The metal liners 72 are made of copper, for example, while the explosive charges 71 are composed of, for example, Composition B. When the explosive charges 71 initiate, the metal liners 72 collide due to the blast energy thereof, and the shaped charge 70 generates an ultra-high-temperature, high-speed metal jet towards the front of the metal liners 72.

The inner explosive 20 is for blasting the chemical ammunition 10 by detonating. Although the inner explosive 20 may be any explosive provided it has a lower detonation velocity than an outer explosive 34 to be subsequently described, that which has fluidity in the manner of a powder or fluid, such as a slurry explosive or emulsion explosive, is used preferably. The detonation velocity of emulsion explosives and slurry explosives is about 5 km/s. Since emulsion explosives in particular are comparatively inexpensive and demonstrate favorable performance, the use of an emulsion explosive makes it possible to reduce the overall cost of blast treatment.

Figure 6:
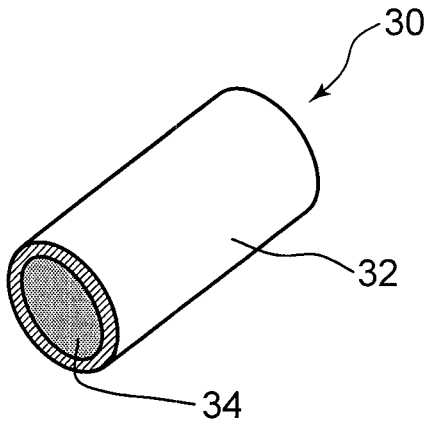
FIG. 6 is a schematic block diagram of a cord-like explosive element used in a blast treatment device according to a first embodiment of the present invention.

The cord-like explosive elements 30 contain the outer explosive 34 for initiating the inner explosive 20, and have a shape that extends in one direction. Here, as shown in FIG. 6, a cord-shaped detonating cord is used for the cord-like explosive elements 30 that has an outer tube 32 made of plastic and the like that extends in one direction, and the outer explosive 34 composed of PETN housed inside the outer tube 32. Here, the detonation velocity of the outer explosive 34 is about 6 km/s, which is adequately greater than the detonation velocity of the emulsion explosive used for the inner explosive 20.

The electric detonator 50 is for initiating the shaped charge 70 and the outer explosive 34. In the present embodiment, a single electric detonator 50 initiates the shaped charge 70 and the outer explosive 34.

The chamber 90 is for carrying out blast treatment on the inside thereof. This chamber 90 has a chamber body 90*b* that opens to the outside and a chamber lid 90*a* capable of opening and closing the opening of the chamber body 90*b*. The inside of the chamber 90 is sealed by closing the chamber lid 90*a*. The chamber 90 has an explosion-proof structure formed by iron and the like, and is sturdily composed so as to withstand the blast pressure generated during blast treatment, as well as prevent harmful substances and the like generated during blast treatment from escaping to the outside when sealed.

The blast treatment method includes each of the following steps.

1) Shaped Charge Placement Step

This step is a step of placing the shaped charge 70 at a location outside the sealed container 40.

In this step, as shown in FIG. 4, on the outer peripheral surface of the sealed container 40, in addition to placing two shaped charges 70*a* and 70*b* in parallel with the axial direction of the sealed container 40, each shaped charge 70*a* and 70*b* is placed so as to be in mutual opposition on both sides of the central axis of the sealed container 40. At this time, each shaped charge 70*a* and 70*b* is respectively fixed in position so that the side of each shaped charge 70*a* and 70*b* on which the metal liners 72 are present faces towards the side of the sealed container 40, and so that the V-shaped apex of each metal liner 72 and the sealed container 40 are separated by a prescribed amount. Since the metal jet concentrates at locations separated by a prescribed amount from the metal liners 72 in particular, if the metal liners 72 and the sealed container 40 are separated by a prescribed amount, the metal jet can be effectively applied to the sealed container 40. More specifically, each of the shaped charges 70*a* and 70*b* are fixed to the outer peripheral surface of the sealed container 40 by fixing to the outer peripheral surface of the sealed container 40 a plurality of legs 76 protruding by a prescribed amount from the metal liners 72 attached to each of the shaped charges 70*a* and 70*b* towards the sealed container 40.

After having fixed each of the shaped charges 70*a* and 70*b*, detonating cords 78 are respectively connected to one end of the shaped charges 70*a* and 70*b* in the lengthwise direction.

2) Blasting Explosive Placement Step

This step is a step of placing the inner explosive 20 and the cord-like explosive elements 30 at locations outside the sealed container 40.

In this step, the inner explosive 20 is first placed around the periphery of the sealed container 40. More specifically, the inner explosive 20 having fluidity is poured into a plurality of bags, and the plurality of bags are placed around the outer periphery of the sealed container 40. In the present embodiment, the bags are tightly placed in those areas other than the areas where the shaped charges 70 are placed.

Next, the cord-like explosive elements 30 are arranged around the inner explosive 20.

In the present embodiment, a preliminarily prepared long, cord-like detonating cord having the outer explosive 34 composed of PETN is cut to match the size and shape of the sealed container 40 and the inner explosive 20 placed around the sealed container 40 to form a plurality of the cord-like explosive elements 30. Here, six cord-like explosive elements 30 are formed having the same length from the detonating cord.

As shown in FIG. 4, the six cord-like explosive elements 30 are respectively arranged on the outside of the inner explosive 20 in parallel with the axial direction of the sealed container 40. More specifically, three of the cord-like explosive elements 30 each are arranged at the portions between the two shaped charges 70*a* and 70*b* so that the distance from the adjacent shaped charge 70 and the distance between adjacent cord-like explosive elements 30 are roughly mutually the same. After having arranged the six cord-like explosive elements 30 in the axial direction of the sealed container 40 in this manner, the two detonating cords 78 connected to the shaped charges 70*a* and 70*b* are connected to the cord-like explosive elements 30 by gathering at a single point along the central axis of the sealed container 40 on the end in the axial direction of the sealed container 40. At this time, each length of the detonating cords 78 from this connection point to each of the shaped charges 70*a* and 70*b* and each length of the cord-like explosive elements 30 from this connection point to the outer periphery of the sealed container 40 are all roughly equal.

Here, this blasting explosive placement step may also be carried out prior to the above-mentioned shaped charge placement step.

3) Housing Step

This step is a step of housing the sealed container 40 in the chamber 90.

In this step, as shown in FIG. 3, the sealed container 40 is placed on a support stand 92 arranged on the bottom of the chamber 90 in a state in which the shaped charges 70*a* and 70*b*, the inner explosive 20 and the cord-like explosive elements 30 are arranged around the periphery thereof. At this time, the sealed container 40 is placed so that the central axis of the sealed container 40 extends in the horizontal direction, and so that the shaped charges 70*a* and 70*b* are respectively opposed in the vertical direction.

This housing step may also be carried out immediately prior to the blasting explosive placement step or prior to the shaped charge placement step and the blasting explosive placement step. Namely, the shaped charge placement step and the blasting explosive placement step may be carried out in a state in which the sealed container 40 has been housed in the chamber 90.

4) Dividing Step and Blasting Step

The dividing step is a step of initiating the shaped charges 70*a* and 70*b* and exposing the chemical ammunition 10 by dividing the sealed container 40 with the shaped charges 70*a* and 70*b*. On the other hand, the blasting step is a step of blast-treating the exposed chemical ammunition 10 with the blast energy of the inner explosive 20 by initiating the inner explosive 20. In the present embodiment, these steps are carried out simultaneously.

First, a detonating cord 52 is connected to the connection point of the cord-like explosive elements 30 and the detonating cords 78 on the end of the sealed container 40, the detonating cord 52 is connected to the electric detonator 50, and the chamber 90 is sealed. A firing cable 60 extending from the electric detonator 50 is then connected to a firing device not shown.

Next, in addition to initiating each of the explosive charges 71 of the shaped charges 70*a* and 70*b*, the outer explosives 34 of the plurality of cord-like explosive elements 30 are initiated with the electric detonator 50 by operating the firing device. As was previously described, since each of the lengths of the detonating cords 78 from the portion where the detonating cord 52 is connected to the shaped charges 70*a* and 70*b* and each of the lengths of the cord-like explosive elements 30 from this connection point to the outer periphery of the sealed container 40 are all roughly equal, each of the explosive charges 71 of the shaped charges 70*a* and 70*b* and each of the outer explosives 34 of the cord-like explosive elements 30 initiate nearly simultaneously.

Figure 5:
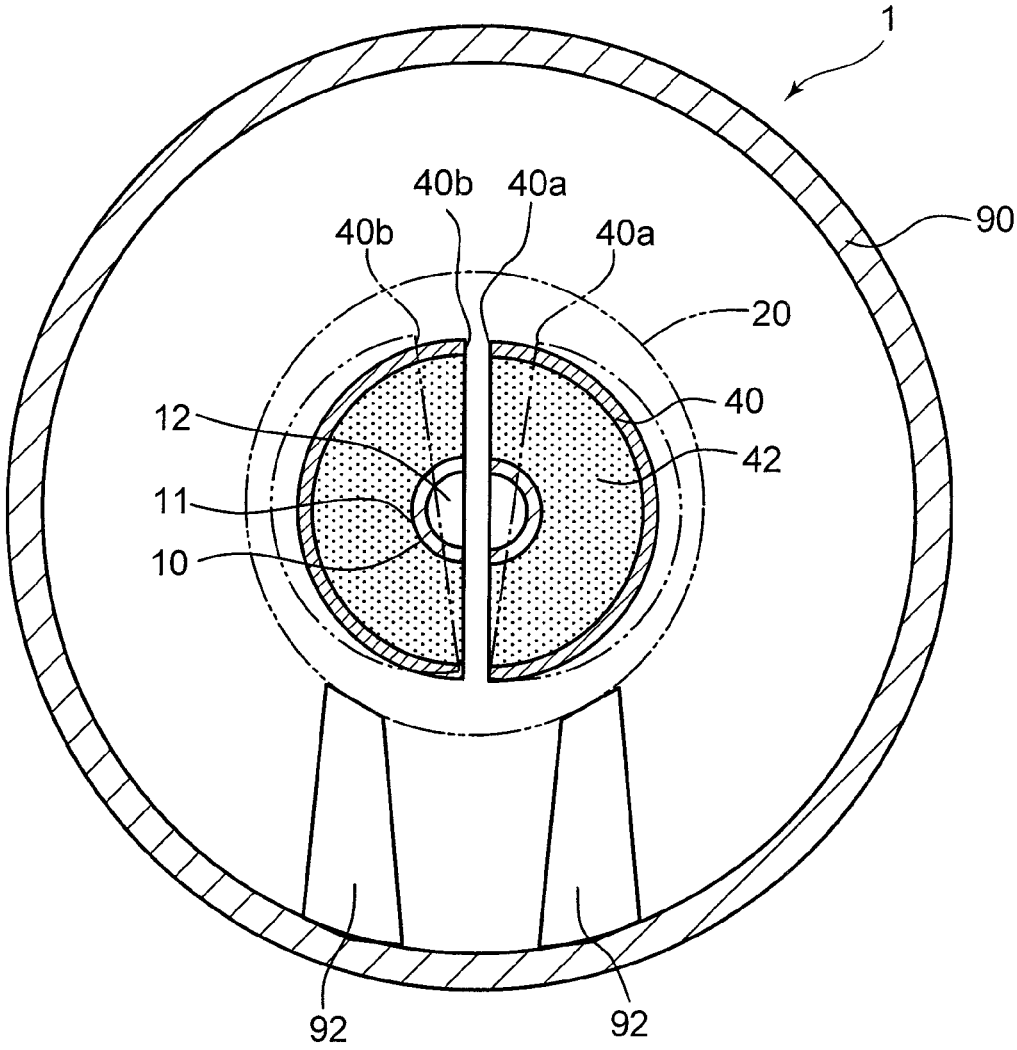
FIG. 5 is a latitudinal cross-sectional view for explaining a dividing step carried out in a blast treatment device according to a first embodiment of the present invention.

The initiated explosive charges 71 explode causing the metal liners 72 to collide. The collided metal liners 72 form a high-temperature, high-speed metal jet, and as shown in FIG. 5, causes the outer peripheral surface of the sealed container 40 to divide. In the present embodiment, the sealed container 40 is divided into two pieces along the axial direction by the shaped charges 70*a* and 70*b*. When the sealed container 40 is divided into two pieces in this manner, the chemical ammunition 10 is exposed on the dividing surfaces 40*a* and 40*b* of the sealed container 40. In the case the force of the metal jet is sufficiently large in particular, as shown in FIG. 5, the cushioning material 42 and the shell 11 of the chemical ammunition 10 are also divided into two pieces, thereby exposing the chemical agent 12 per se.

On the other hand, the initiated outer explosives 34 detonate while initiating the inner explosive 20 due to the blast energy thereof. At this time, since an ultra-high temperature, high-pressure field is formed around the inner explosive 20 by detonation of the outer explosives 34, the detonation vector of the inner explosive 20 is directed inward. As a result, the blast energy of the inner explosive 20 is efficiently propagated to the sealed container 40. The blast energy of the inner explosive 20 destroys the sealed container 40. In addition, the blast energy of the inner explosive 20 causes fragments of the sealed container 40 to collide with the chemical ammunition 10, thereby resulting in decomposition of the chemical agent 12 while destroying the shell 11 of the chemical ammunition 10. In addition, the blast energy of the inner explosive 20 propagates to the inside of the sealed container 40 from the dividing portion of the sealed container 40, thereby decomposing the exposed chemical agent 12 by exposing it to high-temperature, detonation gas.

In this manner, in the present steps, the shell 11, the chemical agent 12 and the sealed container 40, which has a high possibility of being contaminated by the chemical agent 12, are decomposed and rendered harmless by the blast energy of the inner explosive 20. Here, since the sealed container 40 loses balance as a result of being divided, the sealed container 40 moves apart in the direction in which the space between the dividing surfaces 40*a* and 40*b* widens as indicated with the broken lines of FIG. 5, and falls downward while being decomposed as previously described.

In the present embodiment, although the cord-like explosive elements 30 containing the outer explosives 34 are arranged on the outer peripheral surface of the inner explosive 20 at intervals, since the outer explosives 34 are explosives that have adequate blast energy, this blast energy instantaneously propagates around each of the cord-like explosive elements 30. Thus, the outer periphery of the inner explosive 20 explodes nearly simultaneously around its entire circumference in a cross-section perpendicular to the central axis of the sealed container 40, and the blast energy of the inner explosive 20 concentrates at the chemical ammunition 10.

As has been described above, in the present blast treatment method, in addition to initiating the shaped charges 70 and dividing the sealed container 40 with the shaped charges 70 within the chamber 90 to expose the chemical ammunition 10, since the inner explosive 20 provided around the periphery of the sealed container 40 is initiated to apply the blast energy of the inner explosive 20 to the exposed chemical ammunition 10, the chemical ammunition 10 can be blast-treated while still within the same chamber 90. Namely, the chemical ammunition 10 can be treated while inhibiting escape of the chemical agent 12 within the chemical ammunition 10 to the outside.

Here, the cord-like explosive elements 30 containing the outer explosive 34 may be omitted. In this case, the electric detonator 50 and the inner explosive 20 are connected via a detonating cord. However, if the outer explosive 34 having a large detonation velocity is placed outside the inner explosive 20 and the inner explosive 20 is initiated by the outer explosive 34 as in the present embodiment, the detonation vector of the inner explosive 20 can be directed inward, and greater blast energy can be applied to the chemical ammunition 10 and the sealed container 40 while minimizing damage to the chamber 90 by suppressing scattering of fragments of the sealed container 40, fragments of the shell 11 of the chemical ammunition 10 and the chemical agent 12 to the outside. Namely, the chemical ammunition 10 can be rendered harmless more reliably.

In addition, the specific structure of the outer explosive 34 is not limited to that previously described. For example, the outer explosive 34 formed into the shape of a sheet may be wrapped around the outside of the inner explosive 20 instead of the cord-like explosive elements 30. However, if the cord-like explosive elements 30 are used that contain the outer explosive 34 and have a shape that extends in one direction, the outer explosive 34 can be easily placed around the periphery of the inner explosive 20 and blast treatment can be carried out efficiently using a simple method consisting of placing the cord-like explosive elements 30 around the outer periphery of the inner explosive 20.

In addition, the manner in which the inner explosive 20 is placed is also not limited to that previously described. For example, the sealed container 40, the shaped charges 70 and the outer explosives 34 may be placed inside a prescribed container, and the inner explosive 20 may be poured into the space between the inside of this container and the outer periphery of the sealed container 40.

The following provides an explanation of a second embodiment of the blast treatment method according to the present invention with reference to the drawings.

Figure 7:
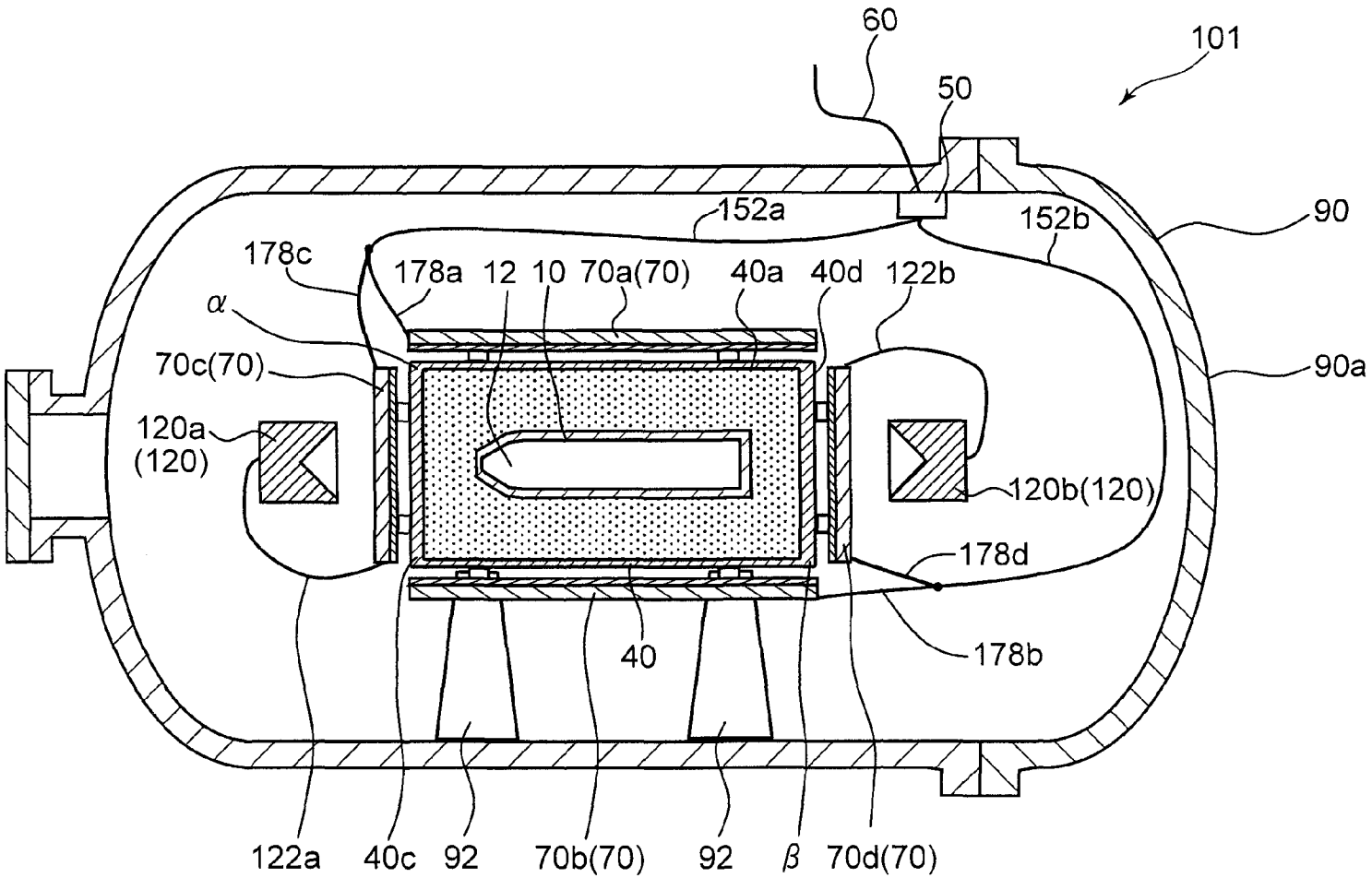
FIG. 7 is a longitudinal cross-sectional view of a blast treatment device according to a second embodiment of the present invention.
Figure 8:
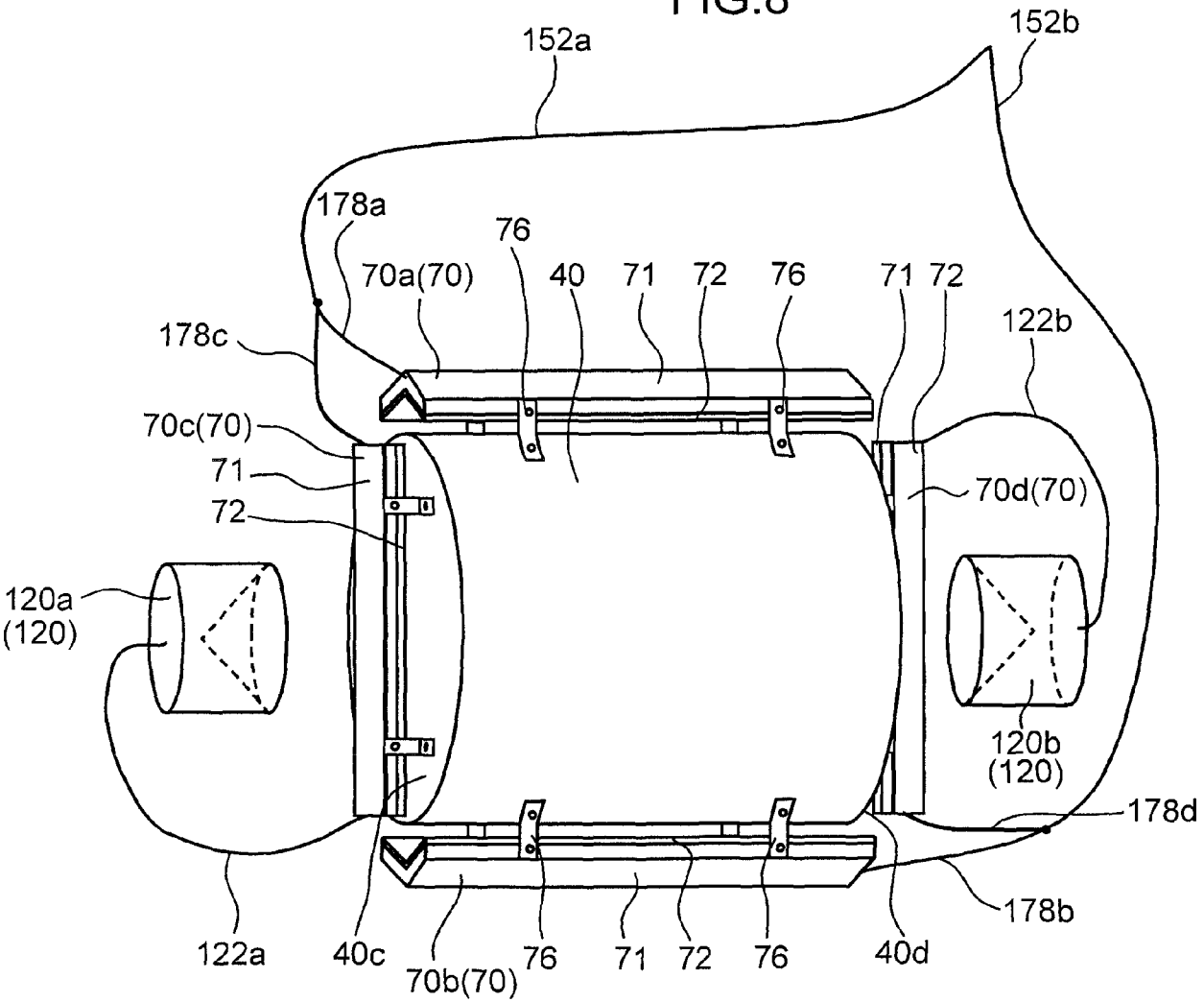
FIG. 8 is a perspective view showing the inside of a blast treatment device according to a second embodiment of the present invention.

FIG. 7 is a cross-sectional view of a blast treatment device 101 used in this second embodiment, while FIG. 8 is a schematic perspective view showing an enlarged view of the inside of the blast treatment device 101. Here, the same reference symbols are used to indicate those constituents of the second embodiment that are the same as those of the first embodiment, and a detailed explanation thereof is omitted. In the present second embodiment, the inner explosive 20 and the cord-like explosive elements 30 of the first embodiment are omitted, and two blasting shaped charges (blasting explosives) 120 to be subsequently described are used to blast the chemical ammunition 10. In addition, two shaped charges 70*c* and 70*d* are further placed on the outside of the sealed container 40 in addition to the two shaped charges 70*a* and 70*b* arranged in parallel to the central axis of the sealed container 40. In the following description, the shaped charges 70*a* and 70*b* are suitably referred to as axial direction shaped charges 70*a* and 70*b*, while the shaped charges 70*c* and 70*d* are suitably referred to as radial direction shaped charges 70*c* and 70*d*.

As shown in FIG. 8, the blasting shaped charges 120 have a roughly cylindrical shape, have cone-shaped indentations formed pointing from the front end to the inside, and have a roughly V-shaped indented cross-section. As a result of being initiated from the opposite side from the portion in which the indentation is formed, namely the rear end, these blasting shaped charges 120, the blast energy thereof concentrates along the central axis of the indentation due to the so-called Munroe effect, thereby making it possible to shoot out a comparatively large amount of energy towards the front. These blasting shaped charges 120 are composed of, for example, trinitrotoluene (TNT) or an emulsion explosive.

In the present embodiment, the four shaped charges 70*a*, 70*b*, 70*c* and 70*d* are placed on the outside of the sealed container 40 (shaped charge placement step). More specifically, the two axial direction shaped charges 70*a* and 70*b* are fixed in parallel with the central axis of the sealed container 40 and in mutual opposition on both sides of the central axis of the sealed container 40 in the same manner as the first embodiment. The two radial direction shaped charges 70*c* and 70*d* are placed so as to be located in the same plane as the axial direction shaped charges 70*a* and 70*b* on the outside a top 40*c* and bottom 40*d* of the sealed container 40. Namely, the four shaped charges 70*a*, 70*b*, 70*c* and 70*d* are respectively fixed along the four sides of a cross-section 40*a* taken along the central axis of the sealed container 40.

After having fixed these shaped charges 70*a*, 70*b*, 70*c* and 70*d* in position, detonating cords 178*a*, 178*b*, 178*c* and 178*d* having mutually equal lengths are respectively connected to one end in the lengthwise direction of the shaped charges 70*a*, 70*b*, 70*c* and 70*d*. As shown in FIG. 7, the detonating cords 178*a* and 178*c* are respectively connected to each end of one of the axial direction shaped charges 70*a* and one of the radial direction shaped charges 70*c* that is close to the apex a of the cross-section 40*a*. The detonating cords 178*b* and 178*d* are respectively connected to each end of the other axial direction shaped charges 70*b* and the other radial direction shaped charges 70*d* that is close to the apex β of the cross-section 40*a* diagonal to the apex α.

Next, the sealed container 40, to which the shaped charges 70*a*, 70*b*, 70*c* and 70*d* have been fixed, is housed in the chamber 90 and placed on the support stand 92 (housing step). At this time, the sealed container 40 is placed so that the axis of the sealed container 40 extends in the horizontal direction, the radial direction shaped charges 70*c* and 70*d* are extending in the vertical direction, and the cross-section 40*a* spreads in the vertical direction.

Next, the two blasting shaped charges 120*a* and 120*b* are placed outside the sealed container 40 (blasting explosive placement step). The blasting shaped charges 120*a* and 120*b* are respectively fixed outside the radial direction shaped charges 70*c* and 70*d* so that the front ends in which the indentations are formed are facing towards the sealed container 40. At this time, the central axes of the indentations are made to be aligned with the central axis of the sealed container 40.

After having fixed each of the blasting shaped charges 120*a* and 120*b*, one end of each of the detonating cords 122*a* and 122*b* is respectively connected to the rear end of each of the blasting shaped charges 120*a* and 120*b*. The other end of these detonating cords 122*a* and 122*b* is connected to the end in the lengthwise direction of the radial direction shaped charges 70*c* and 70*d* opposing each of the blasting shaped charges 120*a* and 120*b*. More specifically, the other ends of the detonating cords 122*a* and 122*b* are connected to the ends in the lengthwise direction of the radial direction shaped charges 70*c* and 70*d* where the detonating cords 178*c* and 178*d* are not connected. At this time, the lengths of the detonating cords 122*a* and 122*b* are set so that the duration of the propagation of detonation from initiation of one end thereof to detonation of the other end is roughly equal to the duration of the propagation of detonation from initiation of one end of the axial direction shaped charges 70*a* and 70*b* to which the detonating cords 122*a* and 122*b* are not connected to detonation of the other end.

Subsequently, together with connecting the connection point of the detonating cord 178*a* and the detonating cord 178*c* to the electric detonator 50 via a detonating cord 152*a*, the connection point of the detonating cord 178*b* and the detonating cord 178*d* is connected to the electric detonator 50 via a detonating cord 152*b*. At this time, the lengths of the detonating cord 152*a* and the detonating cord 152*b* are roughly equal.

Figure 9:
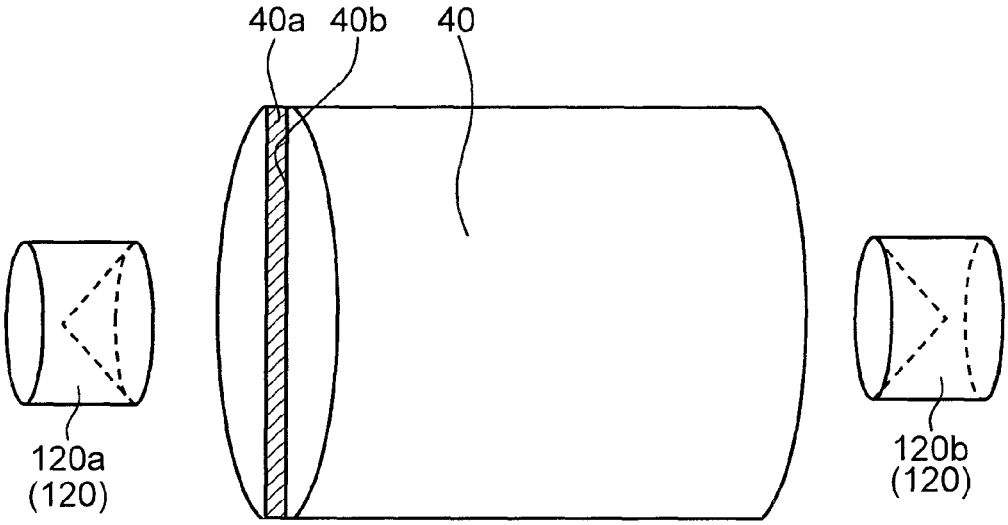
FIG. 9 is a perspective view for explaining a dividing step carried out in a blast treatment device according to a second embodiment of the present invention.

The electric detonator 50 is then connected to an firing device not shown via the firing cable 60, each of the explosive charges 71 of the shaped charges 70*a*, 70*b*, 70*c* and 70*d* are initiated with the electric detonator 50 by operating the firing device, and the sealed container 40 is divided (dividing step). As has been previously described, since the lengths of the detonating cords 178*a*, 178*b*, 178*c* and 178*d* are mutually equal, and the lengths of the detonating cords 152*a* and 152*b* are also mutually roughly equal, each of the explosive charges 71 of the shaped charges 70*a*, 70*b*, 70*c* and 70*d* initiated nearly simultaneously. When the explosive charges 71 initiate, each of the shaped charges 70*a*, 70*b*, 70*c* and 70*d* divide the sealed container 40 along the cross-section 40*a* surrounded by these shaped charges 70*a*, 70*b*, 70*c* and 70*d*. In the present embodiment, the sealed container 40 is sequentially divided in the vertical direction and axial direction from apices α and β of the cross-section 40*a*. Accompanying division of the sealed container 40, the chemical ammunition 10 and the chemical agent 12 are exposed on the dividing surfaces 40*a* and 40*b* of the sealed container 40 shown in FIG. 9.

On the other hand, upon completion of explosion of the explosive charges 71 of the radial direction shaped charges 70*c* and 70*d*, the blasting shaped charges 120*a* and 120*b* are initiated via the detonating cords 122*a* and 122*b* connected to the radial direction shaped charges 70*c* and 70*d*, and the chemical ammunition 10 is blast-treated by the blast energy thereof (blast treatment step). As was previously described, in the present embodiment, the duration of the propagation of the detonation of each of the detonating cords 122*a* and 122*b* is set to be roughly equal to the duration of the propagation of the detonation of the axial direction shaped charges 70*a* and 70*b*. Consequently, the blasting shaped charges 120*a* and 120*b* initiate at a delay equal to the duration of the propagation of the detonation of the radial direction shaped charges 70*c* and 70*d* from completion of detonation of the axial direction shaped charges 70*a* and 70*b*. This duration is, for example, 0.1 ms, and the blasting shaped charges 120*a* and 120*b* initiate immediately after the sealed container 40 is divided by the shaped charges 70*a* to 70*d*.

The initiated blasting shaped charges 120*a* and 120*b* shoot out blast energy towards the front of the indentations. As was previously described, since each indentation is arranged such that the central axis thereof coincides with the central axis of the sealed container 40, the shooting out blast energy is introduced while being concentrated between the dividing surfaces 40*a* and 40*b* formed along the central axis of the sealed container 40. The chemical ammunition 10 and the chemical agent 12, which have been exposed between the dividing surfaces 40*a* and 40*b* where the blast energy has been introduced, are exposed to high-temperature gas causing them to be harmless. In particular, since the blasting shaped charges 120*a* and 120*b* initiate immediately after division of the sealed container 40, the blast energy of the blasting shaped charges 120*a* and 120*b* is limited to the space between the dividing surfaces 40*a* and 40*b* where the energy has not yet adequately spread, thereby enabling the chemical ammunition 10 and the chemical agent 12 to be treated efficiently.

As has been described above, in the present second embodiment, as a result of causing blast energy of the blasting shaped charges 120*a* and 120*b* to propagate from the dividing portion of the sealed container 40 to the chemical ammunition 10 and the chemical agent 12 while being concentrated thereon, the chemical ammunition 10 is blast-treated while suppressing scattering of fragments of the shell 11 of the chemical ammunition 10 and the chemical agent 12 from the dividing portion to the outside.

Here, the method used to initiate the blasting shaped charges 120*a* and 120*b* is not limited to that described above. For example, the blasting shaped charges 120*a* and 120*b* may be connected directly to the electric detonator 50. However, if the blasting shaped charges 120*a* and 120*b* are configured to detonate after detonation of the shaped charges 70*c* and 70*d* by respectively connecting the blasting shaped charges 120*a* and 120*b* to the shaped charges 70*c* and 70*d* via the detonating cords 122*a* and 122*b* as previously described, the blasting shaped charges 120*a* and 120*b* can be initiated immediately after the sealed container 40 has been divided by the shaped charges 70*c* and 70*d* more reliably. As a result, the blast energy of the blasting shaped charges 120*a* and 120*b* can be introduced while concentrated on the dividing portion of the sealed container 40.

Figure 10:
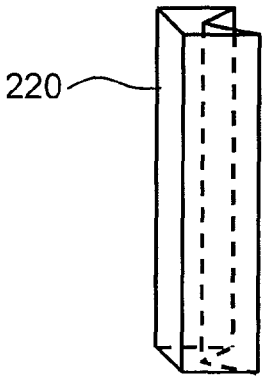
FIG. 10 is a perspective view showing another example of a blasting shaped charge used in a blast treatment device according to a second embodiment of the present invention.

In addition, there are no particular limitations on the number, specific method of placement or structure of the blasting shaped charges 120. For example, blasting shaped charges 120 may be separately added to the outside of the axial direction shaped charges 70*a* and 70*b*. In addition, as shown in FIG. 10, an explosive may be used that has a cross-sectional shape indented in the shape of the letter V that extends in a prescribed direction. In the case of using this explosive 220, it is preferably placed so that the lengthwise direction of the explosive 220 and the lengthwise direction of the radial direction shaped charges 70*c* and 70*d* are roughly parallel.

Next, an explanation is provided of a third embodiment of the blast treatment method according to the present invention with reference to the drawings.

Figure 11:
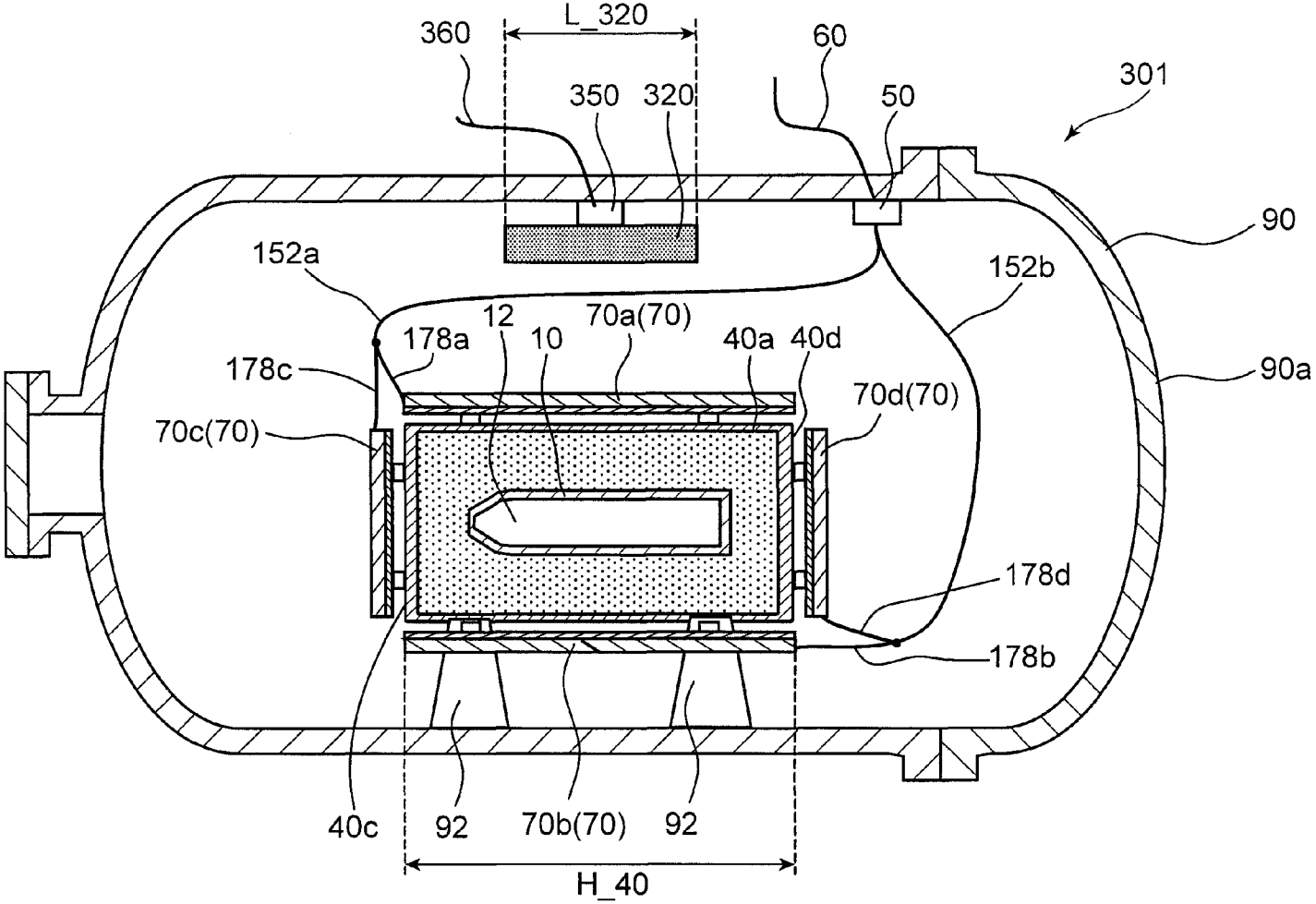
FIG. 11 is a longitudinal cross-sectional view of a blast treatment device according to a third embodiment of the present invention.
Figure 12:
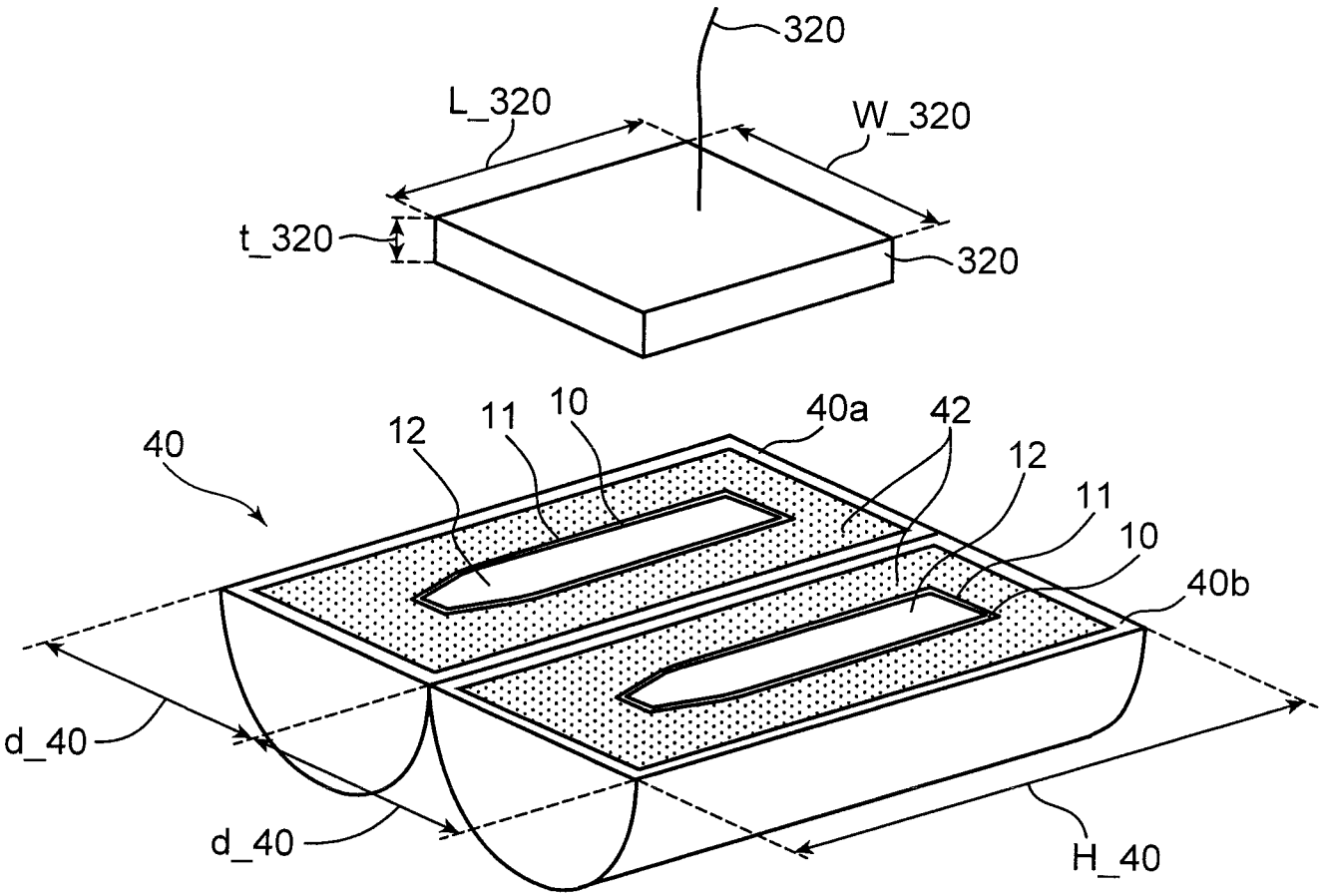
FIG. 12 is a perspective view for explaining a dividing step carried out in a blast treatment device according to a third embodiment of the present invention.

FIG. 11 is a cross-sectional view of a blast treatment device 301 used in this embodiment, while FIG. 12 is a schematic perspective view showing the inside of the blast treatment device 301 after a dividing step to be subsequently described. Here, the same reference symbols are used to indicate those constituents of the third embodiment that are the same as those of the second embodiment, and a detailed explanation thereof is omitted. In the present third embodiment, the blasting shaped charges 120 of the second embodiment are omitted, and the chemical ammunition 10 is blasted using a stationary explosive 320 for the blasting explosive.

The stationary explosive 320 is an explosive, such as an explosive composed of TNT or an emulsion explosive, that has a rectangular shape that has been formed into the shape of a plate. A length W_320 of one side of the plate surface of the stationary explosive 320 nearly coincides with a diameter d_40 of the sealed container 40, and a length L_320 of the other side nearly coincides with a length equal to ½ a height H_40 of the sealed container 40 (length taken along the central axis of the sealed container 40). In addition, a plate thickness t_320 of this stationary explosive 320 is roughly 1/10 the length W_320 of the shorter side of the two sides of the plate surface.

In the present third embodiment, the shaped charge placement step and the housing step are first carried out using the same procedures as in the aforementioned second embodiment. Namely, the four shaped charges 70*a*, 70*b*, 70*c* and 70*d* are respectively fixed to the outside of the sealed container 40 along the four sides of the dividing surface 40*a* along the central axis of the sealed container 40. The detonating cords 178*a*, 178*b*, 178*c* and 178*d* are then respectively connected to one end in the lengthwise direction of the shaped charges 70*a*, 70*b*, 70*c* and 70*d*. Subsequently, the sealed container 40 is then housed in the chamber 90 and placed on the support stand 92 so that the cross-section 40*a* spreads in the vertical direction.

Next, the stationary explosive 320 is fixed to the upper wall of the chamber 90 (blasting explosive placement step). At this time, the plate surface of the stationary explosive 320 is made to spread in the horizontal direction, while the sides where the length L_320 is set to a length equal to ½ the height H_40 of the sealed container 40 are made to extend in parallel with the axial direction of the sealed container 40. Moreover, the center of the stationary explosive 320 is made to align with the center of the sealed container 40 when viewed from above.

After fixing the stationary explosive 320, an electric detonator 350 is connected to the stationary explosive 320. More specifically, the electric detonator 350 is connected to the center of the plate surface of the stationary explosive 320 on the opposite side from the sealed container 40. The electric detonator 350 is connected to a firing device not shown via a firing cable 360. In addition, the connection point between the detonating cords 178*a* and 178*c* is connected to the electric detonator 50 via a detonating cord 152*a*, the connection point between the detonating cords 178*b* and 178*d* is connected to the electric detonator 50 via a detonating cord 152*b*, and the electric detonator 50 is connected to an firing device not shown via the firing cable 60.

Next, each of the explosive charges 71 of the shaped charges 70*a*, 70*b*, 70*c* and 70*d* are initiated by operating the firing device connected to the electric detonator 50. When the explosive charges 71 initiate, the sealed container 40 is divided along the cross-section 40*a* in the same manner as in the second embodiment, and the chemical ammunition 10 and the chemical agent 12 are exposed on the dividing surfaces 40*a* and 40*b* (dividing step). The sealed container 40, which has lost balance as a result of being divided, falls downward with the dividing surfaces 40*a* and 40*b* facing upward as shown in FIG. 12. At this time, the shape of the sealed container 40 when viewed from above is that of a rectangle formed by the dividing surfaces 40*a* and 40*b*. More specifically, the sealed container takes on a rectangular shape formed by sides having a length equal to twice the diameter d_40 of the sealed container 40 and sides having a length equal to the height H_40 of the sealed container. This rectangular shape is analogous to the shape of the plate surface of the stationary explosive 320.

Next, at the point the sealed container 40 has fallen and the dividing surfaces 40*a* and 40*b* have become nearly horizontal, the firing device connected to the electric detonator 350 is operated and the stationary explosive 320 is initiated to blast-treat the chemical ammunition 10 with the blast energy thereof (blasting step). For example, the stationary explosive 320 is initiated 1 second after the sealed container 40 has divided. The initiated stationary explosive 320 detonates inwardly towards the sealed container 40. The blast energy generated from the stationary explosive 320 propagates to the chemical ammunition 10 and the chemical agent 12 exposed on the dividing surfaces 40*a* and 40*b*.

In the present embodiment in particular, since the stationary explosive 320 is placed so that the plate surface thereof is horizontal, and the dividing surfaces 40*a* and 40*b* spread out in the horizontal direction after the dividing step, the blast energy propagates nearly simultaneously to the dividing surfaces 40*a* and 40*b* and in turn to the entire chemical agent 12. In addition, since the plane formed by the dividing surfaces 40*a* and 40*b* and the plate surface of the stationary explosive 320 are set to have analogous shapes, the blast energy propagates nearly uniformly over the entirety of the dividing surfaces 40*a* and 40*b*. Moreover, since the plate thickness t_320 of the stationary explosive 320 is set to be adequately smaller than the lengths W_320 and L_320 of each of the sides of the plate surface of the stationary explosive 320, a shock wave approximating a planar shock wave is generated from the plate surface of the stationary explosive 320 on the side facing the sealed container 40. Namely, the blast energy of the stationary explosive 320 is propagated towards the sealed container 40 without hardly any attenuation. The chemical agent 12, which is subjected to blast energy released from the stationary explosive 320 in this manner, is rendered harmless as a result of being exposed to high-temperature gas.

As has been described above, in the present third embodiment, since blast energy is propagated all at once to the entirety of the exposed chemical ammunition 10 and the chemical agent 12, the chemical ammunition 10 and the chemical agent 12 are treated more uniformly.

Here, the specific structure and initiation procedure of the stationary explosive 320 are not limited to that described above. However, if the stationary explosive 320 is made to roughly be in the shape of a plate and this stationary explosive 320 is initiated from a plate surface on the opposite side from the sealed container 40, a shock wave accompanying detonation of the stationary explosive 320 can be allowed to propagate to the chemical ammunition 10 and the chemical agent 12 in a shape approximating that of a planar shock wave that exhibits little attenuation, thereby enabling blast treatment to be carried out efficiently. In particular, if the plate thickness t_320 is made to be ⅓ or less of the lengths W_320 and L_320 of each of the sides of the plate surface, the resulting shock wave can be made to more closely approximate a planar shock wave. In addition, if the shape of the plate surface of the stationary explosive 320 is made to be analogous to the shape of the sealed container 40 after the dividing step when viewed from above, blast energy can be propagated more uniformly and without waste to the entire sealed container 40.

In addition, the shape of the shaped charges 70, their placement method and the number thereof placed are not limited to that described in the aforementioned first, second and third embodiments. For example, the shaped charges 70 may have a shape such that they are curved around the outer peripheral surface of the sealed container 40. However, if the shaped charges 70*a* and 70*b* are placed along the lengthwise direction of the sealed container 40 as in each of the embodiments, the sealed container 40 is divided in parallel with the lengthwise direction, thereby making it possible to adequately secure an area where the chemical ammunition 10 and the chemical agent 12 are exposed. In addition, if the shaped charges 70*a* to 70*d* are placed over roughly the entire circumference of the outer peripheral edges of the dividing surface 40*a* as in the second and third embodiments, the sealed container 40 can be easily divided at this dividing surface 40*a*, thereby making it possible to easily expose the chemical agent 12.

In addition, the first, second and third embodiments may also be suitably combined. For example, the stationary explosive 320 may be placed on the outside of the sealed container 40 in addition to the aforementioned inner explosive 20, cord-like explosive elements 30 and blasting shaped charges 120.

In addition, the treatment subject with the aforementioned blast treatment method is not limited to the chemical ammunition 10 as previously described. For example, this blast treatment method can also be applied to the case of cleaning a container per se that has been contaminated by a chemical agent by blasting. Namely, according to the present blast treatment method, a chemical agent adhered to the inside of a container can be decomposed and treated by dividing the container that has been contaminated by the chemical agent and applying blast energy to the inside of the container.

As has been described above, the present invention provides a blast treatment method provided with a shaped charge placement step of placing a shaped charge, in which metal plates are integrally molded with an explosive for generating an ultra-high-pressure metal jet in a prescribed direction by colliding the metal plates, at a location outside the sealed container; a blasting explosive placement step of placing a blasting explosive for blasting the treatment subject at a location outside the sealed container; a housing step of housing in a sealable chamber a sealed container in which the treatment subject is housed and housing in a state in which the shaped charge and the blasting explosive are placed at a location outside the sealed container; a dividing step of initiating the shaped charge in the chamber and dividing the sealed container along a prescribed dividing surface with the initiated shaped charge to expose the treatment subject within the chamber; and a blasting step of blast-treating the treatment subject exposed in the chamber with blast energy of the blasting explosive by initiating the blasting explosive in the chamber.

According to this method, together with the treatment subject being exposed comparatively easily as a result of the sealed container being divided by the shaped charge in the chamber, the exposed treatment subject is treated while still housed in the chamber by the blast energy of the blasting explosive as a result of initiating the blasting explosive placed outside the sealed container. Namely, according to this method, the task of exposing the treatment subject by dividing the sealed container and the task of treating the exposed treatment subject can be carried out with the same blast treatment within the same chamber. Thus, a harmful chemical agent contained in the treatment subject is reliably prevented from being dispersed to the outside, and blast treatment of the chemical agent can be carried out safely and easily.

In addition, the shaped charge placement step preferably includes a step of placing the shaped charge along the outer peripheral edges of dividing surfaces of the sealed container. As a result thereof, since the metal jet is generated along the dividing site of the sealed container, the sealed container is efficiently divided at the dividing surfaces.

In addition, the treatment subject has a chemical agent or the like and a casing that houses the chemical agent. It is preferable that the dividing step includes a step of dividing the sealed container and the casing of the treatment subject with the shaped charge in order to expose the chemical agent. In the case the treatment subject has a casing along with the sealed container in this manner, if the chemical agent is exposed by dividing the sealed container along with the casing with the shaped charge, blast energy of the blasting explosive propagates to the chemical agent thereby more reliably decomposing and treating the chemical agent.

In addition, the blasting explosive placement step preferably includes a step of placing an inner explosive that composes the blasting explosive at a location that covers the periphery of the sealed container, and a step of placing an outer explosive, having a detonation velocity greater than that of the inner explosive, at a location outside the inner explosive, and the blasting step includes a step of blast-treating the treatment subject while destroying the sealed container with blast energy of the inner explosive by initiating the outer explosive while also initiating the inner explosive with blast energy released from the outer explosive.

As a result thereof, since the inner explosive detonates in a state in which the detonation vector thereof is directed inward as a result of detonation of the outer explosive prior thereto, blast energy of the inner explosive efficiently propagates to the sealed container and the treatment subject, and the treatment subject is treated more reliably. Namely, not only is the treatment subject decomposed and treated by being exposed to the high-temperature detonation gas after being exposed in the dividing step, but also the treatment subject is treated by collision of the fragments of the sealed container which are generated when the sealed container is fragmented by the energy of detonation of the inner explosive. Moreover, since the explosion vector of the inner explosive is directed inward, fragments of the treatment subject and harmful substances contained in the treatment subject are more reliably suppressed from being scattered to the outside.

Here, the blasting explosive placement step preferably includes a step of placing cord-like explosive elements that contain the outer explosive and have a shape that extends in one direction at a location outside the inner explosive. As a result thereof, the outer explosive can be easily placed outside the inner explosive simply by arranging the cord-like explosive elements at locations outside the inner explosive, and blast treatment can be carried out efficiently.

In addition, the blasting explosive placement step preferably includes a step of placing a blasting shaped charge, which composes the blasting explosive and is formed so that the blast energy thereof is concentrated in a specific direction, at a location at which the outer peripheral edges of the dividing surfaces of the sealed container are in front of the blasting shaped charge in the specific direction, and the blasting step includes a step that is carried out immediately after dividing the dividing surfaces in the dividing step and that is for initiating the blasting shaped charge and allowing the blast energy of the blasting shaped charge to propagate towards a dividing portion of the sealed container. As a result thereof, the blasting energy of the blasting shaped charge is intensively transmitted to the side of the treatment subject from the dividing portion of the sealed container. Thus, it leads to a secure progression of the treatment of the treatment subject, while suppressing a spewing out of the fragments, harmful substances and the like of the treatment subject from the dividing portion of the sealed container and Here, the blasting explosive placement step preferably includes a step of connecting a specific portion of the blasting shaped charge with a specific portion of a shaped charge by using a prescribed detonating cord, and the blasting step includes a step of initiating the shaped charge from a portion of the shaped charge farthest from the specific portion, and initiating the specific portion of the blasting shaped charge by explosion of the detonating cord after having detonated the detonating cord by explosion of the shaped charge. As a result thereof, since the blasting shaped charge is initiated immediately after completion of explosion of the shaped charge more reliably, blast energy of the blasting explosive is more reliably introduced to the dividing portion of the sealed container. Moreover, it is not necessary to initiate the shaped charge and blasting shaped charge individually, thereby simplifying the device.

An example of the blasting shaped charge is that having a cross-sectional shape indented in a V shape and having an axis extending in the specific direction as the central axis thereof. This blasting shaped charge enables blast energy to be concentrated more reliably towards the front in the specific direction.

In addition, the blasting explosive placement step preferably includes a step of placing a stationary explosive that composes the blasting explosive at a location that is away from the sealed container and that opposes dividing surfaces of the sealed container following the dividing step, and the blasting step includes a step that is carried out after the treatment subject has been exposed in the dividing step and that is for causing the blast energy released from the stationary explosive by initiating the stationary explosive to propagate nearly simultaneously to the entirety of the exposed treatment subject. As a result thereof, since blast energy of the stationary explosive is propagated all at once to the entirety of the exposed treatment subject, the treatment subject is treated more uniformly. Moreover, since the stationary explosive is placed at a location opposing the divided surfaces of the sealed container after the dividing step, blast energy of the stationary explosive efficiently propagates to the dividing surfaces and in turn, to the treatment subject.

Here, the blasting explosive placement step preferably includes a step of placing the stationary explosive so that the plate surface thereof and the divided surfaces of the sealed container after the dividing step are roughly parallel, and the blasting step includes a step of initiating detonation of the stationary explosive by initiating the plate surface of the stationary explosive on the opposite side to the plate surface opposing the dividing surfaces. As a result thereof, since the shock wave accompanying detonation of the stationary explosive propagates to the dividing surfaces and in turn, to the treatment subject in a shape approximating that of a planar shock wave that exhibits little attenuation, energy is applied to the treatment subject more efficiently and the treatment subject is treated more reliably.

The plate surface of the stationary explosive preferably has a shape that is analogous to the shape of the sealed container after the dividing step when viewed from above in a direction perpendicular to the plate surface. As a result thereof, blast energy of the stationary explosive propagates more uniformly over the entire sealed container and treatment subject.

For example, if the shape of the stationary explosive is approximately that of a rectangular solid of which the thickness is equal to ⅓ or less the length of each side, the shock wave accompanying detonation of the stationary explosive more closely approximates that of a planar shock wave.

In addition, the present invention provides a blast treatment device for blast-treating a treatment subject housed in a sealed container with an explosive, provided with a shaped charge in which metal plates are integrally molded with an explosive for generating an ultra-high-pressure metal jet in a prescribed direction by colliding the metal plates; a blasting explosive for blast-treating a treatment subject; a chamber capable of being sealed, with the sealed container, the shaped charge and the blasting explosive being housed therein; and a initiation device for respectively initiating the shaped charge and the blasting explosive; wherein the shaped charge is provided at a location that is outside the sealed container and that enables the dividing of the sealed container as a result of being initiated by the initiation device, and the blasting explosive is provided at a location that is outside the sealed container and that enables the blast energy thereof to propagate to the treatment subject that has been exposed as a result of the dividing of the sealed container.

According to this device, the treatment subject is exposed comparatively easily as a result of the sealed container being divided by the shaped charge, the exposed treatment subject is blast-treated by the blasting explosive, and the treatment subject is treated more reliably. In particular, since the shaped charge and the blasting explosive are initiated within the sealed chamber, harmful substances contained in the treatment subject are prevented from escaping to the outside when the treatment subject is exposed, thereby enabling blast treatment to be carried out safely.

The blast treatment device is preferably provided with an inner explosive for blast-treating the treatment subject; and an outer explosive having a detonation velocity greater than that of the inner explosive, wherein the inner explosive is placed at a location that covers the periphery of the sealed container, and the outer explosive, connected to the initiation device, is placed at a position that is outside the inner explosive and that enables the inner explosive to be initiated by the blast energy thereof.

According to this configuration, since detonation vector of the inner explosive is directed inward, and the blast energy of the inner explosive efficiently propagates to the sealed container and the treatment subject, together with the sealed container and the treatment subject being treated more reliably, dispersion of a harmful substance contained in the treatment subject to the outside can be more reliably suppressed.

In addition, the device is preferably provided with a blasting shaped charge for blast-treating the treatment subject that is formed so as to concentrate blast energy in a specific direction, and the blasting shaped charge, placed at a location at which outer peripheral edges of dividing surfaces of the sealed container are in front of the blasting shaped charge in the specific direction, is connected to the initiation device so as to initiate after a delay of a prescribed duration after initiation of the shaped charge.

According to this configuration, since blast energy of the blasting shaped charge propagates to a dividing portion of the sealed container while being concentrated thereon, the treatment subject is treated efficiently while suppressing the scattering of fragments of the treatment subject and harmful substances from the dividing portion to the outside.

In addition, the device preferably has a stationary explosive for blast-treating the treatment subject, and the stationary explosive, placed at a location that is away from the sealed container and that opposes dividing surfaces of the sealed container after the sealing container has been divided by the shaped charge, is preferably connected to the initiation device so as to initiate after a delay of a prescribed duration after initiation of the shaped charge. According to this configuration, since blast energy of the stationary explosive propagates more uniformly to the entirety of the dividing surfaces of the sealed container, the entire treatment subject is treated more reliably.

The invention claimed is:

1. A blast treatment method for blast-treating with an explosive a treatment subject housed in a sealed container, the method comprising:

a shaped charge placement step of placing a shaped charge, in which metal plates are integrally molded with an explosive for generating an ultra-high-pressure metal jet in a prescribed direction by colliding the metal plates, at a location outside the sealed container;

a blasting explosive placement step of placing a blasting explosive for blasting the treatment subject at a location outside the sealed container;

a housing step of housing in a sealable chamber a sealed container in which the treatment subject is housed and housing in a state in which the shaped charge and the blasting explosive are placed at a location outside the sealed container;

a dividing step of initiating the shaped charge in the chamber and dividing the sealed container along a prescribed dividing surface with the initiated shaped charge to expose the treatment subject within the chamber; and a blasting step of blast-treating the treatment subject exposed in the chamber with blast energy of the blasting explosive by initiating the blasting explosive in the chamber.

2. The blast treatment method according to claim 1, wherein the shaped charge placement step includes a step of placing the shaped charge along the outer peripheral edges of dividing surfaces of the sealed container.

3. The blast treatment method according to claim 1, wherein the treatment subject has a chemical agent and a casing that houses the chemical agent, and the dividing step includes a step of dividing the sealed container and the casing of the treatment subject with the shaped charge in order to expose the chemical agent.

4. The blast treatment method according to claim 1, wherein the blasting explosive placement step includes a step of placing an inner explosive that composes the blasting explosive at a location that covers the periphery of the sealed container, and a step of placing an outer explosive, having a detonation velocity greater than that of the inner explosive, at a location outside the inner explosive, and the blasting step includes a step of blast-treating the treatment subject while destroying the sealed container with blast energy of the inner explosive by initiating the outer explosive while also initiating the inner explosive with blast energy released from the outer explosive.

5. The blast treatment method according to claim 4, wherein the blasting explosive placement step includes a step of placing cord-like explosive elements that contain the outer explosive and have a shape that extends in one direction at a location outside the inner explosive.

6. The blast treatment method according to claim 1, wherein the blasting explosive placement step includes a step of placing a blasting shaped charge, which composes the blasting explosive and is formed so that the blast energy thereof is concentrated in a specific direction, at a location at which the outer peripheral edges of the dividing surfaces of the sealed container are in front of the blasting shaped charge in the specific direction, and the blasting step includes a step that is carried out immediately after dividing the dividing surfaces in the dividing step and that is for initiating the blasting shaped charge and allowing the blast energy of the blasting shaped charge to propagate towards a dividing portion of the sealed container.

7. The blast treatment method according to claim 6, wherein the blasting explosive placement step includes a step of connecting a specific portion of the blasting shaped charge with a specific portion of a shaped charge by using a prescribed detonating cord, and the blasting step includes a step of initiating the shaped charge from a portion of the shaped charge farthest from the specific portion, and initiating the specific portion of the blasting shaped charge by explosion of the detonating cord after having initiated the detonating cord by explosion of the shaped charge.

8. The blast treatment method according to claim 6, wherein the blasting shaped charge has a cross-sectional shape indented in a V shape and having an axis extending in the specific direction as the central axis thereof.

9. The blast treatment method according to claim 1, wherein the blasting explosive placement step includes a step of placing a stationary explosive that composes the blasting explosive at a location that is away from the sealed container and that opposes dividing surfaces of the sealed container after the dividing step, and the blasting step includes a step that is carried out after the treatment subject has been exposed in the dividing step and that is for causing the blast energy released from the stationary explosive by initiating the stationary explosive to propagate nearly simultaneously to the entirety of the exposed treatment subject.

10. The blast treatment method according to claim 9, wherein the stationary explosive has the shape of a plate, the blasting explosive placement step includes a step of placing the stationary explosive so that the plate surface thereof and the divided surfaces of the sealed container after the dividing step are roughly parallel, and the blasting step includes a step of initiating explosion of the stationary explosive by initiating the plate surface of the stationary explosive on the opposite side to the plate surface opposing the dividing surfaces.

11. The blast treatment method according to claim 10, wherein the plate surface of the stationary explosive has a shape that is analogous to the shape of the sealed container after the dividing step when viewed from above in a direction perpendicular to the plate surface.

12. The blast treatment method according to claim 10, wherein the stationary explosive has a shape that is approximately that of a rectangular solid of which the thickness is equal to ⅓ or less the length of each side of the plate surface.

13. A blast treatment device for blast-treating a treatment subject housed in a sealed container, the device comprising:

a shaped charge in which metal plates are integrally molded with an explosive for generating an ultra-high-pressure metal jet in a prescribed direction by colliding the metal plates;

a blasting explosive for blast-treating a treatment subject;

a chamber capable of being sealed, with the sealed container, the shaped charge and the blasting explosive being housed therein; and an initiation device for respectively initiating the shaped charge and the blasting explosive; wherein the shaped charge is provided at a location that is outside the sealed container and that enables the dividing of the sealed container as a result of being initiated by the initiation device, and the blasting explosive is provided at a location that is outside the sealed container and that enables blast energy thereof to propagate to the treatment subject that has been exposed as a result of the dividing of the sealed container.

14. The blast treatment device according to claim 13, further comprising:

an inner explosive for blast-treating the treatment subject; and an outer explosive having a detonation velocity greater than that of the inner explosive, wherein the inner explosive is placed at a location that covers the periphery of the sealed container, and the outer explosive, connected to the initiation device, is placed at a position that is outside the inner explosive and that enables the inner explosive to be initiated by the blast energy thereof.

15. The blast treatment device according to claim 13, further comprising a blasting shaped charge for blast-treating the treatment subject that is formed so as to concentrate blast energy in a specific direction, wherein the blasting shaped charge, placed at a location at which outer peripheral edges of dividing surfaces of the sealed container are in front of the blasting shaped charge in the specific direction, is connected to the initiation device so as to initiate after a delay of a prescribed duration after initiation of the shaped charge.

16. The blast treatment device according to claim 13, further comprising a stationary explosive for blast-treating the treatment subject, wherein the stationary explosive, placed at a location that is away from the sealed container and that opposes dividing surfaces of the sealed container after the sealing container has been divided by the shaped charge, is connected to the initiation device so as to initiate after a delay of a prescribed duration after initiation of the shaped charge.

* * * * *